US005688568A

United States Patent [19]

Wolf et al.

[11] Patent Number: 5,688,568

[45] Date of Patent: Nov. 18, 1997

[54] ENHANCED GLOWING LOGS AND METHOD

[75] Inventors: James Frederick Wolf; Ronald John Shimek, both of Prior Lake; Daniel Curtis Shimek, Apple Valley, all of Minn.

[73] Assignee: Heat-N-Glo Fireplace Products, Inc., Savage, Minn.

[21] Appl. No.: 701,352

[22] Filed: Sep. 27, 1996

[51] Int. Cl.[6] ..... F24C 3/04

[52] U.S. Cl. ..... 428/18; 431/125; 126/512; 126/92 R; 126/92 AC

[58] Field of Search ..... 428/15, 18; 126/512, 126/92 R, 92 AC; 431/125

[56] References Cited

U.S. PATENT DOCUMENTS 5,026,579 6/1991 Thow ..... 428/15

*Primary Examiner*—Alexander Thomas

*Attorney, Agent, or Firm*—John B. Sowell-Att

[57] ABSTRACT

A novel fireplace element is made by a novel process wherein the fireplace element is first molded from a mixture of refractory and ceramic fibers and removed from the mold in a green state. While the fireplace element can be treated in the green state, it is preferred that the fireplace element is cured to provide a rigid fireplace element of the type used in artificial fireplace log sets. The element if not already processed is provided with a surface of loosened fibers so that the loose fibers will reach an incandescent glow set state and give the appearance of the total element being incandescent well before the surface and/or body of the fireplace element can reach an incandescent temperature.

15 Claims, 3 Drawing Sheets

ENHANCED GLOWING LOGS AND METHOD

BACKGROUND OF THE INVENTION

1. Related Applications

The present invention employs a molded mixture of refractory ceramic fibers and a binder of the type described in our co-pending application U.S. Ser. No. 08/588,866 filed 19 Jan. 1996 for a UNIVERSAL NON-POROUS FIBER REINFORCED COMBUSTION CHAMBER.

2. Field of the Invention

The present invention relates to artificial logs of the type used in gas fireplaces. More particularly, the present invention relates to a method and a structure which achieves an enhanced incandescence at low temperatures.

3. Description of the Prior Art

It is generally known that ceramic materials as well as ceramic fibers have an inherent temperature at which they will glow or will become incandescent. Heretofore, such fibers have been molded into artificial logs for use in gas fireplaces and stoves. Such logs will glow visibly when heated above the aforementioned incandescence of the ceramic fiber. Typically, incandescence temperatures of ceramic fiber molded artificial logs is about 1470° F. degrees fahrenheit as is described in U.S. Pat. No. 5,026,579 which is incorporated by reference herein.

Applicants have observed that artificial logs vary in density or mass and that the denser logs require a longer time and/or a hotter flame to reach a desired incandescence or glowing state. Presently, there are being sold fireplace units with gas log sets that are intended for use in rooms that are not vented. Such fireplace units are referred to as unvented and claim to be very efficient since all of the heat of combustion as well as the carbon monoxide and carbon dioxide byproducts remain in the unvented room. It is well known that gas stoves have been employed in emergencies to provide heat for a room or a house when other forms of vented heat sources are not available. It is also well known that these unvented gas stoves will burn most of the oxygen in a living area and leave a residue of carbon monoxide poisoning which causes sickness or death, especially in children.

Unvented gas fireplaces create the same deadly products of combustion and there are bills in the legislature of several states to prohibit their use or at least to limit the amount of gas that could be burned to control the amount of carbon monoxide generated in an unvented area over a given period of time. When these limits are set below 10,000 British Thermal Units (BTU) per hour there is not enough heat to create a desirable glow in a typical artificial log set.

Accordingly, it would be desirable to provide artificial fireplace elements or log sets which will achieve a glow at low temperatures and/or low heat input. Alternatively, it will be also desirable to cause fireplace elements for log sets or areas of logs to reach a glowing state more rapidly than was heretofore possible.

SUMMARY OF THE INVENTION

It is a principal object of the present invention to provide a ceramic fiber fireplace element that will reach incandescence with lower heat input than was heretofore possible.

It is a principal object of the present invention to provide a method of making fireplace elements that will reach a glow state with lower heat inputs and/or at faster rates.

It is another object of the present invention to provide fireplace elements having improved aesthetic values.

It is another object of the present invention to provide fireplace elements having preselected areas that will glow leaving other areas dark to exactly simulate a burning wooden log of mound of embers.

It is another object of the present invention to enhance the glow effect of a log set by intentionally creating heat traps and reflecting combustion chambers within the log sets.

According to these and other objects of the present invention, a molded fireplace element is formed from a mixture of refractory ceramic fibers and a binder solution. The molded fireplace element is cured to provide a rigid fireplace element of the type used in artificial log sets. The surface of the fireplace unit and/or predetermined selected areas of the fireplace unit are processed to loosen the fibers at the surface of the fireplace unit so that the loose fibers will reach an incandescence glow state and give the appearance of an incandescent surface before the body surface of the fireplace unit or element can reach an incandescence temperature.

DETAILED DESCRIPTION OF THE PREFERRED EMBODIMENT

Figure 1:
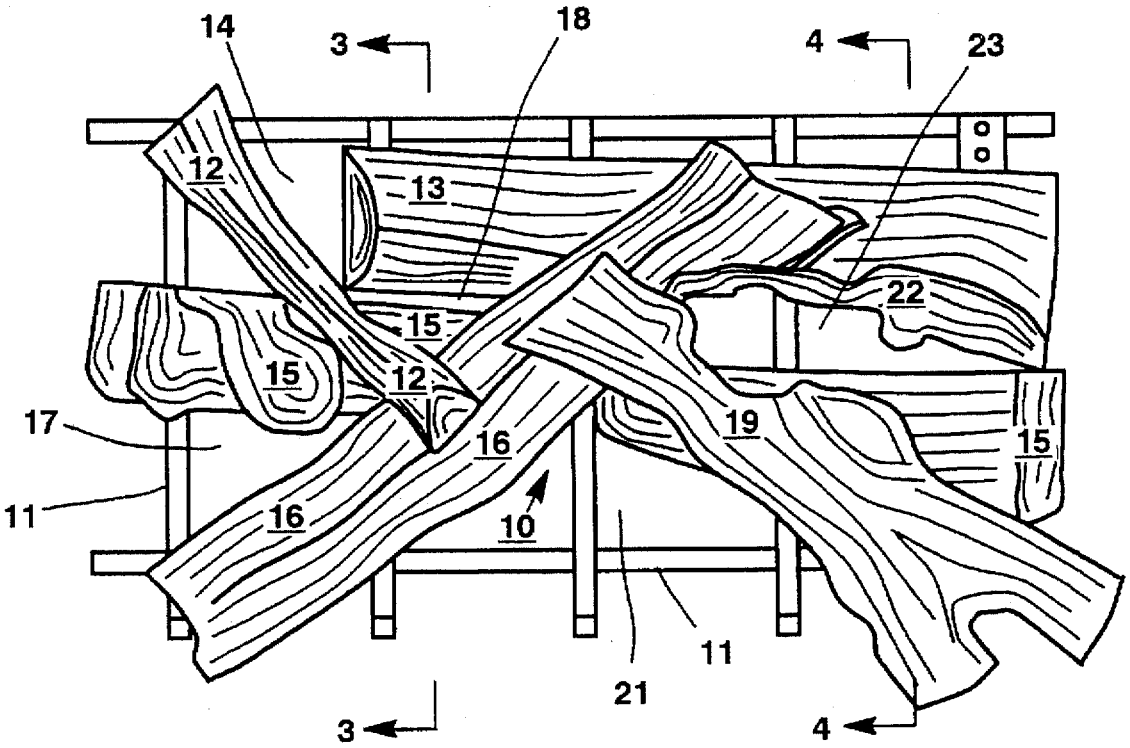
FIG. 1 is a plan view of a typical fireplace log set arranged on a supporting grate.

Refer now to FIG. 1 showing a plan view of a typical fireplace log set 10 arranged on a supporting grate 11. It will be noted that logs 12 and 13 form a chamber with the unnumbered floor at a point 14. Further, a chamber 17 is formed between logs 15 and 16 and the unnumbered floor. Also, there is a chamber 18 formed between logs 13 and 15 and the unnumbered floor. Further, there is a chamber formed at point 21 between logs 16, 19 and the unnumbered floor. There is a chamber generally at point 23 between logs 19 and 22 and log 15. As will be explained hereinafter these key traps or chambers trap heat and enhance the glow effect of the novel enhanced artificial logs.

Figure 2:
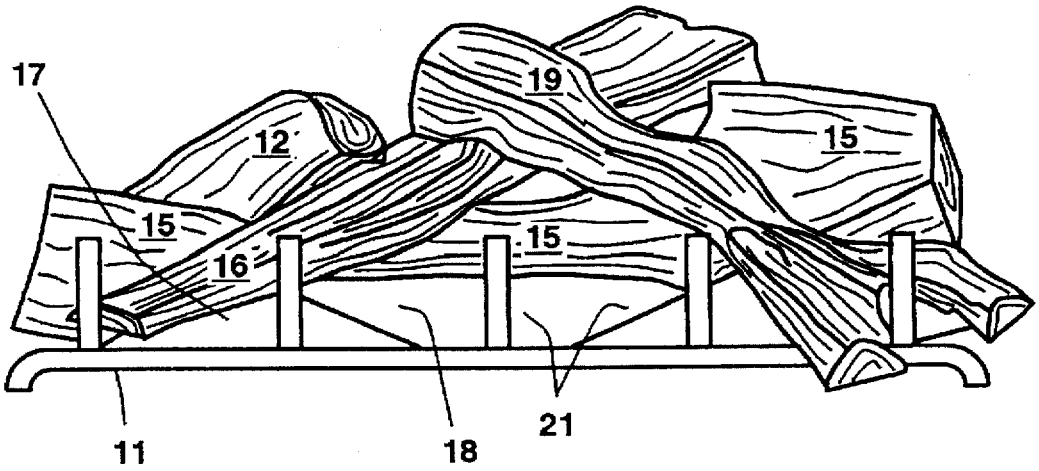
FIG. 2 is a front view and elevation of the fireplace set shown in FIG. 1.

Refer now to FIG. 2 showing a front view in elevation of the fireplace log set shown in FIG. 1. It will be understood that the point 17 forms a chamber which is generally under and between logs 15 and 16 and the unnumbered floor. Further, the aforementioned point 14 and chamber to the rear cannot be seen but is in front log 12. There is further a chamber 18 which is under log 15 and in front of log 13 (not shown). Further there is a combustion chamber or point under log 16 and 19 and in front of log 15. The chamber or point 23 in front of log 22 is not seen in FIG. 2 since it is behind log 15. It will be understood that the grate 11 supports the aforementioned fireplace set 10 above a gas burner which may be of one of several types known in the art.

Figure 3:
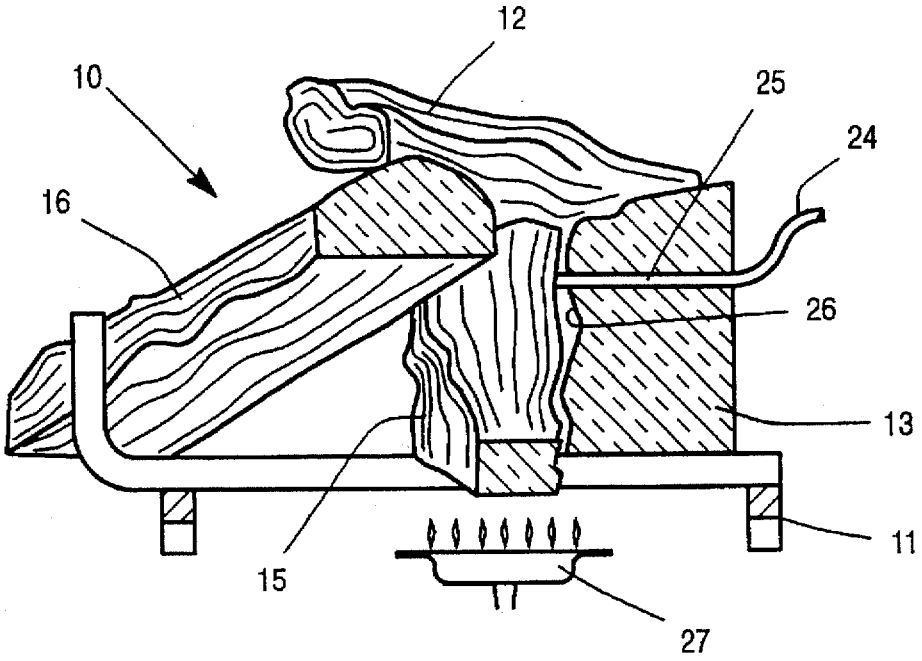
FIG. 3 is a section in elevation taken at lines 3—3 of FIG. 1.

Refer now to FIG. 3 showing a section in elevation taken in elevation taken at lines 3—3 of FIG. 1. To provide data for proof of the present invention, a thermocouple 24 was inserted through an aperture ending at the surface 26 of log 13. By inserting the thermocouple 24 from the rear, the applicants were able to determine the surface temperature of the log 13 without regard to the log set arrangement 10 comprising logs 12, 15 and 16. Further, there is shown a flat pan burner 27 of the type that may be employed with the fireplace set 10. In the experiments that were conducted, the log 13 was removed from the fireplace set and the experiments were conducted in a test environment to determine the surface temperature 26 of the log 13 and also to observe when the incandescence or glow effect started.

Figure 4:
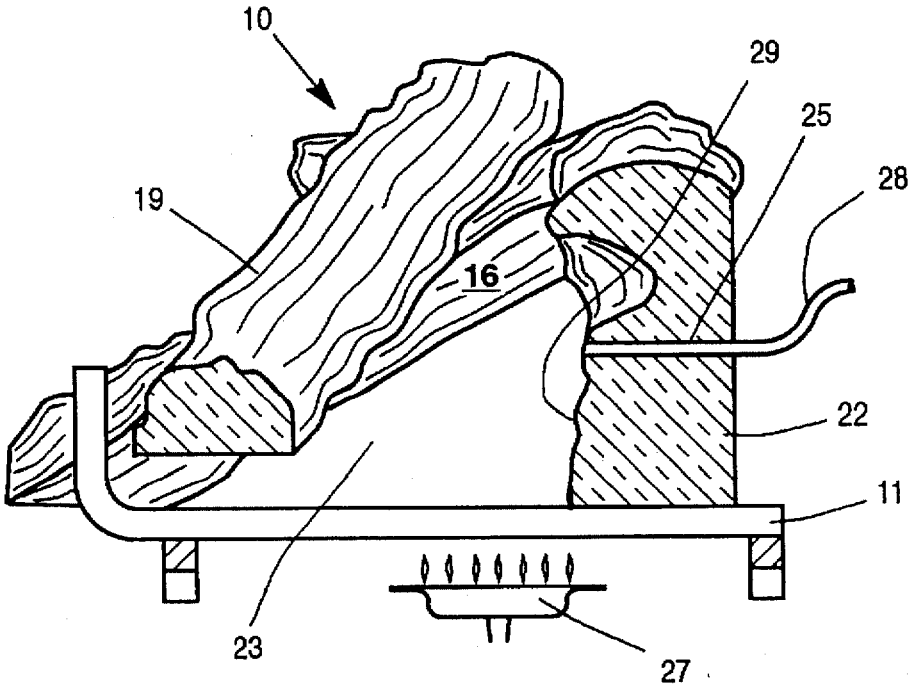
FIG. 4 is a section in elevation taken at lines 4—4 of FIG. 1.

Refer to FIG. 4 showing a section in elevation taken at lines 4—4 of FIG. 1. In this view a thermocouple 28 was inserted in a similar aperture 25 to extend to the surface 28 of the log 22. The other logs 19 and 16 are shown forming the aforementioned chamber 23 which enhances the glow effect. It will be noted that a burner 27 of the type shown in FIG. 3 is also provided to supply the heat input to the chamber 23 and cause the glow effect on the surface of the logs 16, 19 and 22 as will be described in greater detail hereinafter.

Figure 5:
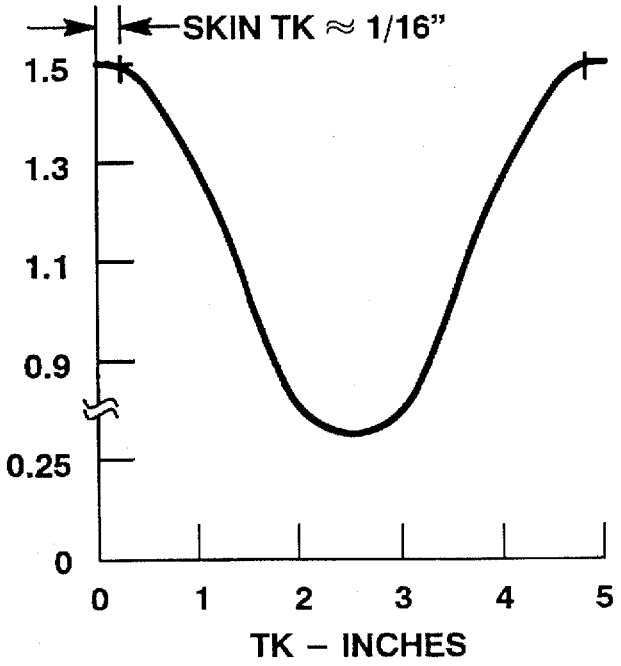
FIG. 5 is a graph or a plot of the density of a typical prior art log taken through a section of the log.

Refer now to FIG. 5 showing a graph or plot of density of a typical prior art log taken through a section of the log. The prior art log has a skin thickness of approximately 1/16" and the specific gravity is approximately 1.5 grams/cubic centimeter. The typical log depicted here is approximately 5 inches in thickness and for purposes of this plot is assumed to be approximately cylindrical. Thus, it is shown that the specific density or gravity of the prior art log is very high at the skin surface for approximately 1/16th of an inch and rapidly decreases in density to a value slightly above 0.25 grams/cubic centimeter. Then symmetrically increases back to the skin value of 1.5 grams/cubic centimeter for approximately 1/16th of inch skin thickness. On the numerous prior art fireplace log elements available to the applicants the skin surface or outer skin surface of all of the samples available were substantially hard and smooth which may be a characteristic of the smoothness of the mold in which they were made. None of the logs observed had been post treated in any manner which could be observed under numerous tests.

Figure 6:
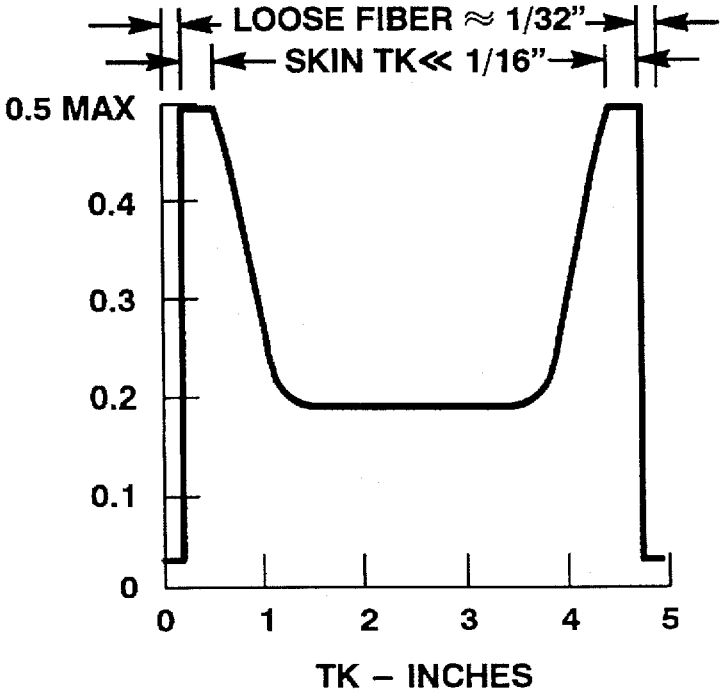
FIG. 6 is a graph or a plot of the density of the present invention log taken through a section of the log.

Refer now to FIG. 6 showing a graft or plot of density of the present invention artificial log taken through a section of the log. It will be noted that there is a loose fiber area which is approximately 1/32th inch thick that is substantially a fuzzy fiber area having a specific density of less than 0.001 grams/cubic centimeter which is attached to the skin surface of the log which has a skin thickness that is much less than 1/16th of an inch and usually around 1/32th of an inch. The center of the present invention log is shown having a specific density of approximately 0.2 grams/cubic centimeter which is approached rapidly from the skin surface. Since the samples that were made for this test were substantially cylindrical in shape, the plot shown in FIG. 6 is also symmetrical. The center core is soft and the skin is substantially harder having a density of 0.5 grams/cubic centimeter maximum and is provided with a loose fiber or fuzzy area on the surface which has a thickness of approximately 1/32th of an inch and having a specific gravity of less than 0.001 grams/cubic centimeter.

When the present invention log with the loose fiber on top of the surface area was inserted in a fireplace environment or a test environment, the loose fibers began to glow within a matter of seconds and well less than 1 minute. At this time the surface of the logs being tested with thermocouple probes was well below 900° F. degrees fahrenheit and glow had begun at around 700° F. degrees fahrenheit. Thus, it can be concluded that the areas which were treated to produce the loose fibers or fuzz will reach a glow or incandescence state even if the body and surface of the log does not reach a temperature in excess of 900° F. This temperature at which the enhanced glow occurs is well below the prior art observed incandescence temperature of artificial logs and ceramic fibers.

Stated differently it is now possible to create an incandescent glow effect of a fuzzy surface on an artificial log without regard to or the necessity of bringing the complete log to an incandescence temperature which was necessary for the observed glow effect heretofore in the prior art.

While conducting these experiments it was also observed that an enhanced aesthetic result could be achieved by treating only portions of an artificial log where it was desired that the glow effect or enhanced glow effect be made visible. This is to say that a log can have a predetermined area or portion treated by the present invention so that it will glow as if it was a glowing ember portion of the log and the remaining portion of the log remained dark. This was not possible heretofore in the prior art using artificial logs. In the prior art it was not possible to have predetermined areas of the artificial logs glow and other areas dark. However, it was known that by placing an artificial log in an area of the combustion chamber or opposite the burner that was much hotter than the remaining portion of the log it was possible to bring a portion of a log in that area up to its incandescence temperature but the desired area of incandescence could not be controlled as in the present invention.

Having explained the present invention and the manner in which the artificial logs are treated, it will be understood that even if legislative bodies require that unvented fireplace systems may only employ a burner which has an output that would normally be insufficient to raise a artificial log fireplace set to incandescence, it is now possible to generate the glow effect on any of the desired areas at the treated portions of the logs without the necessity of the amount of heat that would be required to drive the logs or portions thereof to incandescence.

Having explained the preferred embodiment result and the manner in which the surface is treated it is possible to obtain the fuzzy area or loose fibers in post processing as well as during processing. When the surface of the molded part is still in the wet stage before it is cured, it is possible to apply a vacuum wand or vacuum device to the surface or portions of the surface of the wet molded element. In this manner the surface fibers are loosened and will form a loose fuzzy area. However, in the preferred embodiment of the present invention, it was determined that post operative processing was the most desirable step in obtaining the fuzzy area which could be carefully controlled even when using sand blasting or mechanically abrading with rough instruments or sand paper or wire brushing. When the preferred wire brushing was employed to loosen the fibers at the surface, it was possible to control the thickness as well as the selected areas.

What is claimed is:

1. A method of making fireplace elements incandescent at low temperatures, comprising the steps of:

forming a fireplace element from a mixture of refractory ceramic fibers and a binder solution, curing said fireplace element to provide a rigid fireplace element of the type used in artificial log sets, reducing the specific gravity of the surface of the fireplace unit by loosening the fibers at the surface so that the loose fibers will reach an incandescence glow state and give the appearance of an incandescent surface before the surface of the fireplace element can reach an incandescent temperature.

2. The method of making fireplace elements as set forth in claim 1 wherein the step of loosening the fibers at the surface comprises the step of brushing the surface of the fireplace element to loosen said fibers.

3. The method of making fireplace elements as set forth in claim 2 wherein the step of brushing comprises the step of brushing with a wire brush.

4. The method of making fireplace elements as set forth in claim 2 wherein the step of brushing comprises forming a fuzzy layer of loose fibers which will glow when heated.

5. The method of making fireplace elements as set forth in claim 2 wherein the step of brushing comprises forming a fuzzy layer of loose fibers which glow well before the surface of said fireplace element reaches an incandescence temperature.

6. The method of making fireplace elements as set forth claim 1 wherein the step of loosening the fibers at the surface comprises loosening a layer of loose fibers over a surface of the fireplace element wherein an incandescence glow is desired.

7. The method of making fireplace elements as set forth in claim 6 wherein the step of forming a layer of loose fibers comprises the step of forming a fuzzy layer of fibers up to 1/32th of an inch thick.

8. The method of making fireplace elements as set forth in claim 1 wherein the step of loosening fibers at the surface comprises sand blasting a layer of the fibers over a surface of the fireplace element where an incandescence glow is desired.

9. The method of making fireplace elements as set forth in claim 1 wherein the step of loosening the fibers at the surface comprises applying a vacuum during the wet stage after molding to loosen the fibers at the surface where an incandescent glow is desired.

10. The method of making fireplace elements as set forth in claim 1 wherein the step of loosening the fibers at the surface comprises blowing the surface during the wet stage to loosen the fibers at the surface of the fireplace element where an incandescent glow is desired.

11. A fireplace element used in gas fireplaces, comprising:

an artificial log comprising refractory ceramic fibers and a binder, said fireplace element having a low specific gravity center portion and a higher density portion surface skin portion that was formed from a forming mold, and a fuzzy area of loosened fibers extending outward from said surface skin portion capable of sustaining a glow effect.

12. A fireplace element as set forth in claim 11 wherein said fuzzy area comprises loose fibers approximately 1/64th inch in thickness.

13. A fireplace element as set forth in claim wherein said fuzzy area extends over predetermined parts or selected areas of said fireplace element.

14. A fireplace element as set forth in claim 11 wherein said fireplace element comprises a portion of a fireplace log set.

15. A fireplace element as set forth in claim 14 wherein said fireplace element comprises a bed of glowing embers.

* * * * *